US005395516A

United States Patent [19]

Gray

[11] Patent Number: 5,395,516

[45] Date of Patent: Mar. 7, 1995

[54] FILTRATION SYSTEM

[75] Inventor: Gary E. G. Gray, Westwood Heath, United Kingdom

[73] Assignee: Courtaulds Fibres (Holdings) Limited, London, England

[21] Appl. No.: 69,182

[22] Filed: May 28, 1993

[51] Int. Cl.[6] ..... B01D 29/60

[52] U.S. Cl. ..... 210/87; 210/134; 210/142; 210/253; 210/258; 210/259; 210/323.2; 210/340; 210/416.1; 210/510.1

[58] Field of Search ..... 425/197, 198, 199; 210/134, 141, 142, 253, 254, 258, 259, 323.2, 335, 340, 346, 416.1, 510.1, 87

[56] References Cited

U.S. PATENT DOCUMENTS

| | | | |
|---|---|---|---|
| 3,088,592 | 5/1963 | Clark | 210/253 |
| 4,139,463 | 2/1979 | Murphy et al. | 210/259 |
| 4,944,875 | 7/1990 | Gaignet | 210/253 |
| 5,141,638 | 8/1992 | Mori et al. | 210/510.1 |
| 5,160,444 | 11/1992 | McFarland | 210/254 |

FOREIGN PATENT DOCUMENTS 1446299 8/1976 United Kingdom .

*Primary Examiner*—Robert A. Dawson
*Assistant Examiner*—W. L. Walker
*Attorney, Agent, or Firm*—Davis, Hoxie, Faithfull & Hapgood

[57] ABSTRACT

A filtration system for filtering dope of a solvent-spun fiber manufacturing plant in which dope to be spun flows from a source of supply (10) through a series of filter assemblies (15) (21) (23) to jets (22(*b*)) of each spinning heads (22). The filtration system comprises, in flow series, a first stage filter assemblies (15) having filter elements with the finest pore size of the series (typically 20μ) and a final stage filter assembly (23), immediately upstream of the jets (22(*b*)) of each spinning head (22). The final stage filter assembly is of the coarsest pore size of the series of filters (typically 80μ) and is equal to, or less than, the size of the jet holes (typically 80μ). The filter media of intermediate filter assemblies (21) between the first (15) and final (23) stages increase in pore size as one progresses from the first filter assembly (15) to the final filter assemblies (23) along the flow path.

10 Claims, 2 Drawing Sheets

FILTRATION SYSTEM

BACKGROUND OF THE INVENTION

This invention relates to a filtration system for a solvent-spun fibre manufacturing process and plant.

In the manufacture of solvent-spun fibres such as, for example, Tencel cellulose fibres (Tencel is a trade mark of Courtaulds Fibres Limited), a dope comprising an aqueous solution of woodpulp and amine oxide, is supplied under pressure to a spinning head. The spinning head comprise a plurality of spinnerette jets which are typically 80μ or less in diameter. The dope is extruded through the spinnerette jets into a spin bath where the solvent is leached out of the fibre and the fibre is washed by water. The fibres are collected, washed and dried whilst the waste aqueous amine oxide solution is recovered and returned to the process.

The spinnerette jets are typically of the order of 80μ diameter and are carefully shaped and designed to optimise fibre production. In a modern fibre production plant, there can be as many as 200 spinning heads with up to six spinnerette plates each of which could have as many as 7,000 jet holes of 80μ diameter. It is therefore essential to filter out particles or lumps in the dope which could block the spinnerette jet holes. The most obvious way to do this is to provide a series of filters of decreasing mesh sizes with the first filter of the series having the coarsest mesh and the downstream most filter, immediately in front of the spinnerette jets, having the smallest mesh size (less size than the diameter of the spinnerette jet). The finer the mesh, the more efficient will be the filter and the more likely it is to block up rapidly.

It has been found to be impractical to achieve satisfactory filtration of the dope when using a series of filters arranged with decreasing mesh sizes because the finest filter immediately upstream of the filter blocks up easily and requires frequent changing and cleaning.

Furthermore, because of the large number of filters that would be required upstream of the spinning heads, (one for each spinning head), and the need to change them frequently, if they were to be of much smaller mesh than the diameter of the jets (80μ) it would be impossible to achieve a satisfactory design of filter, which is easy to clean.

An object of the present invention is to provide a filtration system for a solvent-spun fibre manufacturing process which comprises a plurality of sets of filters in flow series and which are easy to clean without disrupting the flow of dope to the spinning heads of the process plant.

SUMMARY OF THE INVENTION

According to one aspect of the present invention there is provided a dope filtration system for a solvent-spun fibre manufacturing process in which dope to be spun into fibre is caused to flow through a plurality of filters from a source of supply to one or more spinning heads which have a plurality of spinnerette jet holes of predetermined diameter, the filtration system comprising, in flow series, a plurality of filter assemblies of different pore sizes, the pore size of the filter media of a first of the filter assemblies being of the smallest size of all the filter asssemblies, and the, or each, subsequent filter assembly of the series having pore size which will filter out particles larger than that filtered out by the first of the filter assemblies, and the filter media of the final filter assembly of the series of filter assemblies having a pore size which will filter out particles at least equal to the size of the spinnerette jet holes.

Preferably there are at least three filter assemblies between the source of supply of dope and the, or each, spinnerette head.

Preferably the first filter assembly comprises at least two filters, connected in parallel in the flow path from the source of supply of dope to the, Dr each, spinnerette head, diverter valve means selectively operable so as to connect at least one of the filters in the flow path and disconnect at least one of the filters from the flow path, and means for adjusting the rate of flow of the dope through one or both of the filters of the first filter assembly so as to maintain a substantially constant flow of dope from the first filter assembly as selected filters of the first filter assembly are connected into, or disconnected from the flow path.

Preferably the first of the filter assemblies comprises first and second filters connected in parallel between the source of supply of dope to be filtered and an outlet for the filtered dope, a first diverter valve located at an inlet to the first and second filters and selectively operable to divert dope to be filtered to a selected one or both of the filters, a variable speed pump means located upstream of the filters, a second diverter valve located at the outlet of the first and second filters and being selectively operable to receive flow of filtered dope from a selected one or both of the filters and to direct the filtered dope to the outlet for the filtered dope, a sensor means means downstream of the filters for monitoring the flow of filtered dope and operable to produce a signal indicative of the flow of filtered dope through the first and second filters, and means responsive to the signal generated by the sensor means which is operable to control the speed of the pump means to maintain a predetermined flow of filtered dope through the first filter assembly.

Preferably the first filter assembly comprises a plurality of tubes having a filter media made of sintered metal fibres matting mounted in a sealed vessel.

Preferably the filter media of the first filter assembly have a pore size which will filter out particles in the range of 20μ to 30μ.

Preferably the filter media of the final filter assembly has a pore size which will filter out particles of between 30μ to 40μ.

In the caes where there is one or more intermediate filter assembly the filter media of the one or more intermediate filter assemblies has a pore size which will filter out particles in the range of 30μ to 40μ.

In a preferred embodiment of the invention,the diameter of the spinnerette jet holes is in the range of 70μ to 80μ, a first of the filter assemblies has a pore size which will filter out particles of between 20μ to 30μ, a second of the filter assemblies downstream of the first filter assembly has a pore size which will filter out particles of between 30μ to 40μ, and a third of the filter assemblies downstream of the second filter assembly has a filter media which has a pore size which will filter out particles less than 80μ.

BRIEF DESCRIPTION OF THE DRAWINGS

The present invention will now be described by way of an example with reference to the accompanying drawings in which.

DETAILED DESCRIPTION

Figure 1:
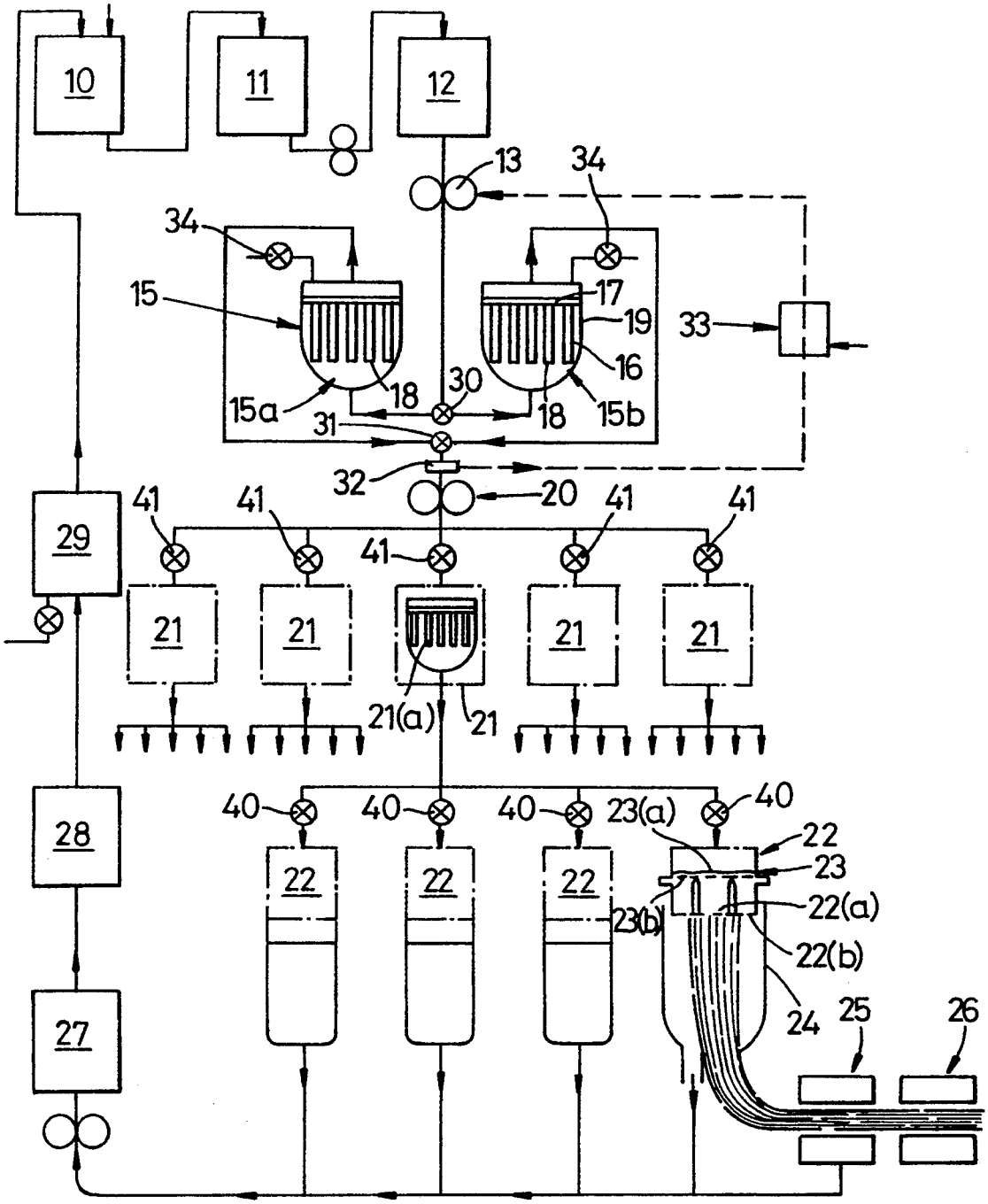
FIG. 1 shows schematically a plant for solvent spinning of cellulose fibres using a dope filtration system constructed in accordance with the present invention.

Referring to FIG. 1, dope, comprising woodpulp dissolved in an aqueous solution of 76% to 78% by weight of amine oxide (4-methyl morpholine-4-oxide), is supplied from a tank 10 via a filmtruder 11 and tank 12 to the Inlet of a feed pump 13 which supplies the dope to the first filter assembly 15 of a series of filters. The feed pump 13 is a variable speed pump which delivers a predetermined volume of dope at the outlet of the filter assembly 15 at a predetermined speed of the pump 13.

Figure 2:
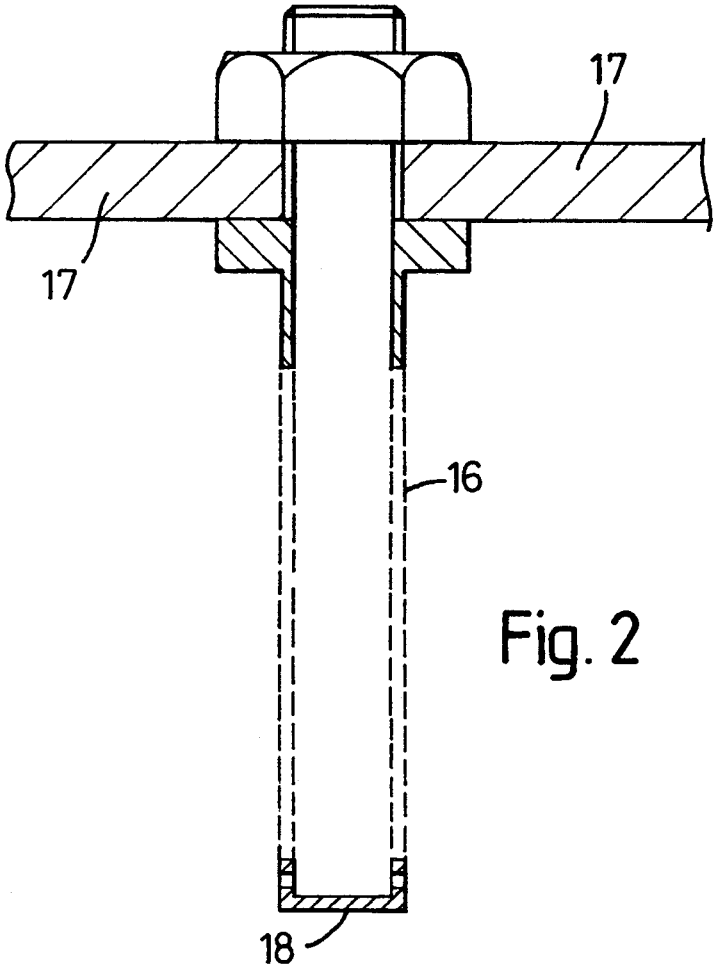
FIG. 2 shows in greater detail one filter element of the first filter assembly of the plant shown in FIG. 1.
Figure 3:
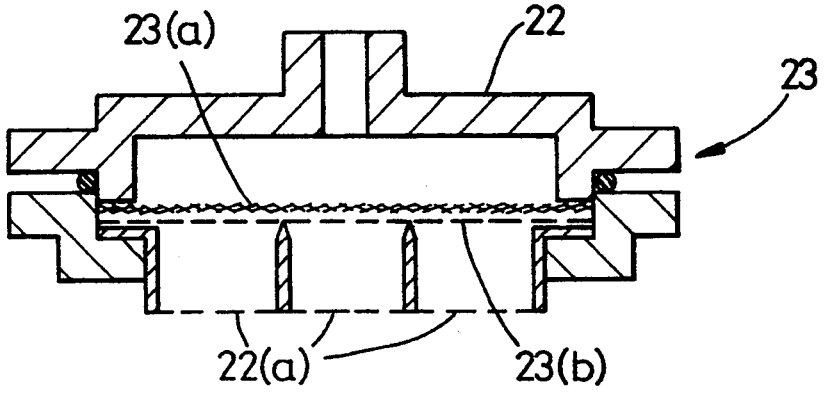
FIG. 3 shows in greater detail the one of the final filter assemblies of the plant shown in FIG. 1.

Referring to FIG. 2 each of the filter elements 16 of the filter assembly 15 comprises tubular filter element mounted at one end in a header plate 17. Each of the tubes 16 is blanked off at the one end 15 and the cylindrical wall of the tube comprises a porous filter media formed from sintered stainless steel fibre matting which is pleated longitudinally along the length of the tube. The header plate is assembled into the filter vessel 19 (see FIG. 1) to make a sealed chamber. The filter media of the elements 16 have a pore size of between 20μ to 30μ (preferably 20μ) and are required to filter out particles and lumps in the dope that are greater than 20μ.

The dope which passes through the filter assembly 15, is pumped by a second pump 20 (called the spin feed pump) to a plurality of second filter assemblies 21 (only one of which is shown in detail). Each second filter assembly 21 is of a similar construction as the filter elements 16 but the sintered stainless steel fibre matting has a pore size of the order of 30μ to 40μ (preferably 40μ) which filters out particles or lumps of 40μ or greater.

The dope which passes through each filter assembly 21 is supplied to a plurality of spinning heads 22. In a modern plant there are as many as 200 spinning heads, each of which has a plurality of spinnerette plates 22(*a*). Each spinnerette plate has as many as 7,000 trumpet shaped spinnerette jet holes 22(*b*) of typically 70μ to 80μ diameter formed in it.

Immediately upstream of the jets 22(*b*) of each head 22 is a final filter assembly 23 which comprises a filter media made of two sintered stainless steel meshes 23(*a*) supported on a foraminated plate 23(*b*). The pore size of the filters 23 is of the order of 30μ to 40μ and will filter out particles or lumps greater than the 30μ from the dope. The filters 15 and 21 are made of staple length stainless steel fibres sintered together to form a mat which is relatively thick (compared with the thickness of the meshes of filter 23), and retain dirt more effectively than the filters 23. However the filters 23 have a more precise pore size and are effective at filtering out particles of 30μ.

Spun fibre is extruded through the spinnerette jet holes into a spin bath 24 where the solvent is leached from the fibre and the fibre is washed with water. The spun fibre is collected and passes through a wash region 25 and a drying oven 26.

Waste aqueous solution of the amine oxide from the spin bath 24 is returned to the tank 10 via filter 27 and ion exchanger 28, and the water is evaporated by the evaporator 29.

From the above, it will be seen that the filtration system of the present invention between the dope supply 10 and each spinning head 22 comprises in flow series the first filter assembly 15, one of the second filter assemblies 21 and one of the third filter assemblies 23. Of the three filter assemblies 15, 21, 23 the filter media of each first filter assembly 15 is of the finest pore size (20μ), and the filter media of each of the filters 23 of each third-filter assembly are the coarsest pore size 70μ to 80μ. The filter media of each intermediate filter assembly 21 is of a pore size of the order of 40μ. This is the reverse of what one would normally expect. However it has been found to be advantageous because a small number of large capacity filters 15 of fine pore size can be used to filter the bulk of the dope, and can be easily changed without disrupting the flow of dope. On the other hand, the large number of filters 23, being of the coarsest pore size of the three filter assemblies 15, 21, 23, are less likely to block up and therefore require less frequent changing. Furthermore individual spinning heads 22 can be isolated by the provision of isolation valves 40 easily to replace the filters 23 without disrupting the whole production of fibre. Similarly isolation valves 41 may be provided upstream of each filter assembly 21 to enable selected filters 21 to be removed and cleaned without disrupting flow of dope to the other filters Referring to FIG. 1, first filter assembly 15 is shown in more detail. There are essentially two parallel banks of filters, 15A and 15B, only one of which is usually connected on-line at a time, except when changing over filters. For the following description it is assumed that the on-line filter is that shown as 15A and the other filter 15B is on "stand-by". On the outlet side of the dope feed pump 13 is a diverter valve 30 which is manually selectively variable from a first position where 100 per cent of the flow of dope passes through the filter 15A to a second position where 100 per cent of the flow dope is through filter 15B. At intermediate positions of the valve 30 the flow is proportioned to both filters 15A and 15B.

The outlet of the first filter assembly 15 is connected to a common inlet of the spin feed pump 20 via a second diverter valve 31. The spin feed pump 20 is a constant volume pump which runs at a constant speed to supply a uniform flow rate of dope to each spinnerette head 22.

A pressure sensor and transducer 32 is provided at the inlet of the spin feed pump 20 and operates through a speed control circuit 33 to control the speed of the dope feed pump 13 in order to maintain a constant flow of dope to the inlet of the spin feed pump 20. In other words, as the on-line filter 15A starts to block up, the pressure tends to drop at the inlet to the pump 20 and the control circuit 33 operates to increase the speed of the dope feed pump 13 and thereby tends to restore the pressure and maintain the flow rate constant at the inlet to pump 20.

If the pressure drop across the filter 15A reaches a predetermined value which indicates the on-line filter 15A is too blocked to continue safely, the filters 15A and 15B are changed in the following manner.

The fresh clean filter elements 16 of the filter 15B are assembled in their respective vessel 19 and the diverter valve 30 is operated so as to divert some of the dope into the fresh clean filter 15B. A bleed valve 34 is operated to bleed all the air from the vessel 19 as it fills up. Opening the valve 30, to fill the spare filter 15B causes a slight pressure drop across the filter 15A which is sensed by the sensor and transducer 32. To compensate for this one can slow down the spin feed pumps 20 slightly so that production of fibre is decreased by the amount of solvent diverted to the fresh filter whilst maintaining the speed of the feed pump 13 constant. Alternatively, the pump 13 could be speeded up slightly by the control circuit 33 to compensate for the filling of the spare filter 15B and the spin feed-pumps 20 maintained at constant speed.

When the filter 15B is completely filled with dope, and all air is expelled from its vessel 19, the bleed valve 34 is closed, the diverter valve 31 is opened gradually to connect filter 15B to the pumps 20 and at the same time the diverter valve 30 is operated so as to divert the supply of dope from the blocked filter 15A to the fresh filter 15B. As this is done, the speed of the pump 13 is adjusted under the control of the pressure control circuit 33 to maintain a constant flow rate of dope to the pumps 20. In the case where the pumps 20 were slowed down to compensate for the diversion of dope to filter 15B pumps 20 are speeded up to restore the flow of dope to the spinning heads to the previous production level. The blocked filter 15A is drained of its contents and can then be removed from the plant for cleaning.

In the plant shown in FIG. 1 the second filter assemblies 21 are not duplicated and cannot be changed without isolating the spinning heads supplied by the filters 21. However, if desired, each second filter assembly 21 may comprise two filters similar to that for filter assembly 15 and similar valves (not shown) to the valves 30, 31 as used in the first filter assembly 15. These valves may be used and operated in the same way as the valves 30 and 31 so as to enable the flow of dope through a blocked filter 21 to be diverted through a second fresh filter 21. Here again, a pressure sensor and control circuit (not shown) could be provided to control the speed of each pump 20 so as to compensate for any changes in the pressure drop across the filters 21 when changing the filters 21.

I claim:

1. In a solvent-spun fiber manufacturing process in which dope to be spun into fiber is caused to flow from a source of supply to a spinning head having a plurality of spinerette jet holes of predetermined diameter, a filter system for filtering said dope between said source of supply and said spinning head, said system comprising a series of at least two filter assemblies of different pore sizes, the pore size of the assembly in said series nearest the source of supply being the smallest of the series and the pore size of the assembly nearest the spinning head being at most equal to the diameter of the jet holes of said spinning head.

2. A filter system according to claim 1 wherein there are at least three filter assemblies between the source of supply of dope and the spinning head.

3. A filter system according to claim 1 wherein the filter assembly nearest the source of supply comprises at least two filters, connected in parallel in the flow path from the source of supply of dope to the spinning head, diverter valve means selectively operable so as to connect at least one of said filters in the flow path and disconnect at least one of said filters from the flow path, and means for adjusting the rate of flow of the dope through said filters of the filter assembly nearest the source of supply so as to maintain a substantially constant flow of dope from said filter assembly as selected filters of said filter assembly are connected into, or disconnected from the flow path.

4. A filter system according to claim 1 wherein the filter assembly nearest the source of supply comprises first and second filters connected in parallel between the source of supply of dope to be filtered and an outlet for the filtered dope, a first diverter valve located at an inlet to said first and second filters and selectively operable in a first mode to divert dope to be filtered to a selected one of the filters and in a second mode to divert dope to be filtered to both of said filters, a variable speed pump means located upstream of said filters, a second diverter valve located at the outlet of said first and second filters and being selectively operable to receive flow of filtered dope from a selected one or both of said filters and to direct the filtered dope to the outlet for the filtered dope, a sensor means downstream of said filters for monitoring the flow of filtered dope and operable to produce a signal indicative of the flow of filtered dope through said first and second filters, and means responsive to the signal generated by the sensor means which is operable to control the speed of the pump means to maintain a predetermined flow of filtered dope through said filter assembly nearest the source of supply.

5. A filter system according to claim 1 wherein the filter assembly nearest the source of supply comprises a plurality of tubes having filter media made of sintered metal fibres matting mounted in a sealed vessel.

6. A filter system according to claim 1 wherein the filter media of the filter assembly nearest the source of supply have a pore size which will filter out particles in the range of $20\mu$ to $30\mu$.

7. A filter system according to claim 1 wherein the filter media of the filter assembly nearest the spinning head have a pore size which will filter out particles of between $30\mu$ to $40\mu$.

8. A filter system according to claim 1 and comprising at least one intermediate filter assembly with filter media having a pore size which will filter out particles in the range of $30\mu$ to $40\mu$.

9. A filter system according to claim 1 wherein the diameter of the jet holes of the spinning head is in the range of $70\mu$ to $80\mu$, and wherein the filter system comprises at least three filter assemblies, a first of the filter assemblies having a pore size which will filter out particles of between $20\mu$ to $30\mu$, a second of the filter assemblies downstream of the first filter assembly having a pore size which will filter out particles of between $30\mu$ to $40\mu$, and a third of the filter assemblies downstream of the second filter assembly having a pore size which will filter out particles less than $80\mu$.

10. A filter system according to claim 1 wherein the filter assembly nearest the source of supply constitutes the bulk filter and the remainder of said filter assemblies constitute line filters between the bulk filter and the spinning head.

* * * * *

UNITED STATES PATENT AND TRADEMARK OFFICE

CERTIFICATE OF CORRECTION

PATENT NO. : 5,395,516

DATED : March 7, 1995

INVENTOR(S) : Gary E.G. Gray

It is certified that error appears in the above-indentified patent and that said Letters Patent is hereby corrected as shown below:

| | | |
|---|---|---|
| Col. 2, | line 9, | cancel "Dr" and substitute --or--. |
| Col. 3, | line 24, | cancel "15" and substitute --18--. |
| Col. 4, | line 29, | after "filters", insert --21--. |

Signed and Sealed this

Twenty-seventh Day of June, 1995

*Attest:*

Bruce Lehman

BRUCE LEHMAN

*Attesting Officer*

*Commissioner of Patents and Trademarks*